US008855521B2

(12) United States Patent
Yamaki et al.

(10) Patent No.: US 8,855,521 B2
(45) Date of Patent: Oct. 7, 2014

(54) IMAGE FORMING APPARATUS

(75) Inventors: Hideo Yamaki, Tokyo (JP); Shigetaka Kurosu, Tokyo (JP); Hiroshi Morimoto, Tokyo (JP); Satoshi Nishida, Saitama (JP); Yusuke Nishisaka, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 69 days.

(21) Appl. No.: 13/300,969

(22) Filed: Nov. 21, 2011

(65) Prior Publication Data

US 2012/0134700 A1 May 31, 2012

(30) Foreign Application Priority Data

Nov. 26, 2010 (JP) ..... 2010-263289

(51) Int. Cl.
*G03G 15/00* (2006.01)
*G03G 15/16* (2006.01)

(52) U.S. Cl.
CPC ..... *G03G 15/161* (2013.01); *G03G 2215/0135* (2013.01)
USPC ..... 399/101; 399/346; 399/359

(58) Field of Classification Search
CPC ..... G03G 15/16
USPC ..... 399/66, 98–99, 101, 346
See application file for complete search history.

(56) References Cited

U.S. PATENT DOCUMENTS 5,867,755 A * 2/1999 Sato ..... 399/149
6,173,135 B1 * 1/2001 Yuminamochi et al. ..... 399/66
7,738,807 B2 * 6/2010 Inada et al. ..... 399/71
7,894,759 B2 * 2/2011 Yagi ..... 399/352
8,081,912 B2 * 12/2011 Saito et al. ..... 399/298
2006/0034632 A1 * 2/2006 Takada et al. ..... 399/101
2006/0056869 A1 * 3/2006 Sato et al. ..... 399/66
2007/0059067 A1 * 3/2007 Tanaka et al. ..... 399/346
2012/0134700 A1 * 5/2012 Yamaki et al. ..... 399/71

FOREIGN PATENT DOCUMENTS

JP 2002-311711 10/2002
JP 2002-311771 * 10/2002
JP 2005-031431 2/2005
JP 2007-328088 12/2007

OTHER PUBLICATIONS

Japanese Office Action, Patent Application No. 2010-263289, date of drafting: Mar. 20, 2014 (3 pages).
English translation of Japanese Office Action, Patent Application No. 2010-263289, date of drafting: Mar. 20, 2014 (4 pages).

* cited by examiner

*Primary Examiner* — Clayton E LaBalle
*Assistant Examiner* — Kevin Butler
(74) *Attorney, Agent, or Firm* — Lucas & Mercanti, LLP

(57) ABSTRACT

An image forming apparatus including: an image forming section having a intermediate transfer body to carry a toner image on a photoreceptor and transfer the toner image onto a sheet of paper; a cleaning section for removing residual toner on the intermediate transfer body by bringing a cleaning blade into close contact with the intermediate transfer body; and a control section for controlling a rotation of the intermediate transfer body so as to carry out a return action of a blade configuration which stops or reverses the rotation of the intermediate transfer body, when a rotation amount reaches a predetermined value, wherein the control section carries out the return action when the rotation amount reaches a value smaller than the predetermined value, in a case where a plurality of previous printing jobs is determined to be intermittent printing.

5 Claims, 9 Drawing Sheets

IMAGE FORMING APPARATUS

RELATED APPLICATION

This application is based on Japanese Patent Application No. 2010-263289 filed on Nov. 26, 2010 in Japan Patent Office, the entire content of which is hereby incorporated by reference.

TECHNICAL FIELD

The present invention relates to an image forming apparatus comprising a cleaning device which cleans the surface of an image bearing member by bringing a blade into close contact with the surface.

BACKGROUND ART

In general, in a cleaning device used for an image forming apparatus, the major method has been that toner on an image bearing member is removed by continuously bringing a blade made of a material such as urethane rubber into close contact with the image bearing member. In this method, it has been known that foreign matter such as paper powder is caught at the pointed end of a blade whereby the lip of the blade or cleaning failure is caused. As a countermeasure against the problem, there is disclosed in Patent Documents 1 to 3 as shown below a method in which, to remove foreign matter from the pointed end of a blade, an image forming job being run is interrupted to stop the movement of an image bearing member or to rotate it in the reverse direction.

The image forming apparatus described in Japanese Patent Application Publication No. 2002-311771 is provided with a cleaning action of a blade in which a photoreceptor is rotated in the opposite direction to the direction at the time of image formation, and carries out the cleaning action at every prescribed interval of the number of image formation to make it possible to maintain excellent cleaning properties over a long period of time. The prescribed interval is selected based on the number of cartridges used or environmental conditions (temperature or humidity).

The image forming apparatus described in Japanese Patent Application Publication No. 2005-31431 has a cleaning action of a blade in which the apparatus controls a photoreceptor driving motor to stop the photoreceptor, rotate it in the reverse direction and then rotate it in the normal direction during job operations of continuous printing, and returns to the original continuous printing job, and thereby repeats the cleaning action of a blade in a unit of the number of prescribed printing to prevent accumulation of paper powder at an edge of the blade, and to decrease printing failure and improve reliability.

Further, in the image forming apparatus described in Japanese Patent Application Publication No. 2007-328088, a cleaning action of a blade is repeated in which the direction of rotation of the photoreceptor is reversed at every prescribed number of rotations in accordance with the number of rotations of the photoreceptor.

However, it was found that cleaning failure on the intermediate transfer body cannot be sufficiently prevented, in the image forming apparatus comprising an image forming section for forming a toner image on a photoreceptor on which a lubricant is applied, and then transfers the toner onto an intermediate transfer body; a transfer section for transferring the toner image formed on the intermediate transfer body onto a sheet of paper; and an intermediate transfer cleaning section for cleaning the surface of intermediate transfer body by continually bringing a cleaning blade into close contact with the intermediate transfer body, even if the technology described in Patent Documents 1 to 3, that is, the cleaning action of a blade in which, to remove foreign matter such as paper powder from the blade, a printing job is interrupted during an operation of continuous printing job at every prescribed interval to stop rotation of the intermediate transfer body or to rotate it in the reverse direction is carried out.

This problem is one in which, when a continuous printing, in which several-hundreds of sheets are processed, is carried out after intermittent printing was repeated many times, a cleaning failure occurs prior to reaching the above prescribed interval, that is, prior to a cleaning action of the cleaning blade (a return of blade configuration) is carried out.

The object of the present invention is to provide an image forming apparatus capable of preventing cleaning failure which occurs when continuous printing, in which several-hundreds of sheets are processed, is carried out after intermittent printing was repeated many times.

SUMMARY

To achieve the abovementioned object, image forming apparatuses reflecting one aspect of the present invention can be attained by the image forming apparatuses described as follows.

Item 1. An image forming apparatus comprising: an image forming section including a photoreceptor, a charging section for charging the photoreceptor, an exposing section for exposing the photoreceptor charged by the charging section to form an electrostatic latent image, a developing section for developing the electrostatic latent image to form a toner image, an intermediate transfer body, a primary transfer section for transferring the toner image onto the intermediate transfer body, a secondary transfer section for transferring the toner image on the intermediate transfer body onto a sheet of paper, and a photoreceptor cleaning section having a lubricant applying section for applying a lubricant onto the photoreceptor; a cleaning section for removing residual toner remaining on the intermediate transfer body by bringing a cleaning blade into close contact with the intermediate transfer body, and a control section for controlling a rotation of the intermediate transfer body so as to carry out a return action of a blade configuration which stops or reverses the rotation of the intermediate transfer body when a rotation amount of the intermediate transfer body, which continuously rotates, reaches a first predetermined value, wherein the control section carries out the return action of the blade configuration when the rotation amount of the intermediate transfer body in a current printing job reaches a second predetermined value which is smaller than the first predetermined value, in a case where a plurality of previous printing jobs, which were carried out prior to the current printing job at work, is determined to be intermittent printing in which the developing section has a high stop rate during rotation of the intermediate transfer body.

Item 2. The image forming apparatus described in above Item 1, wherein the plurality of previous printing jobs is determined to be the intermittent printing or not, or the second predetermined value is set, based on a number of sheets of paper which passed through for each of a plurality of previous printing jobs which fall under a range in which the rotation amount of the intermediate transfer body goes back by a predetermined amount of rotation from a job just before the current printing job.

Item 3. The image forming apparatus described in above Item 1, wherein the previous printing job is determined to be the intermittent printing or not, or the second predetermined value is set, based on a first rotated distance which is a total amount of distance in which the intermediate transfer body rotated in a plurality of previous printing jobs which fall under a range in which the rotation amount of the intermediate transfer body goes back by a predetermined amount from a job just before the current printing job, and a second rotated distance which is a total amount of distance in which the intermediate transfer body rotated during rotation of the developing section in the plurality of previous printing jobs which fall under a range in which the rotation amount of the intermediate transfer body goes back by a predetermined amount from a job just before the current printing job.

Item 4. The image forming apparatus described in above Item 1, wherein the previous printing job is determined to be the intermittent printing or not, or the second predetermined value is set, based on a rotation time of the intermediate transfer body which is a total amount of time in which the intermediate transfer body rotated in a plurality of previous printing jobs which fall under a range in which the rotation amount of the intermediate transfer body goes back by a predetermined amount of rotation from a job just before the current printing job, and on a working time of the developing section which is a total amount of time in which the developing section worked in the plurality of previous printing jobs which fall under a range in which the rotation amount of the intermediate transfer body goes back by a predetermined amount of rotation from a job just before the current printing job.

Item 5. The image forming apparatus described in any one of above Items 2 to 4, wherein the criterion whether the previous printing job is the above intermittent printing or not is changed, or the second predetermined value is set, based on the average coverage rate of an image formed by the plurality of previous printing jobs which fall under a range in which the rotation amount of the intermediate transfer body goes back by a predetermined amount from a job just before the current printing job.

DETAILED DESCRIPTION OF PREFERRED EMBODIMENTS

Hereinafter embodiments of the present invention will be described. The technical scope of the claims or meanings of the terms are not limited by the descriptions in this section.

<<Image Forming Apparatus of Electrophotographic System>>

Figure 1:
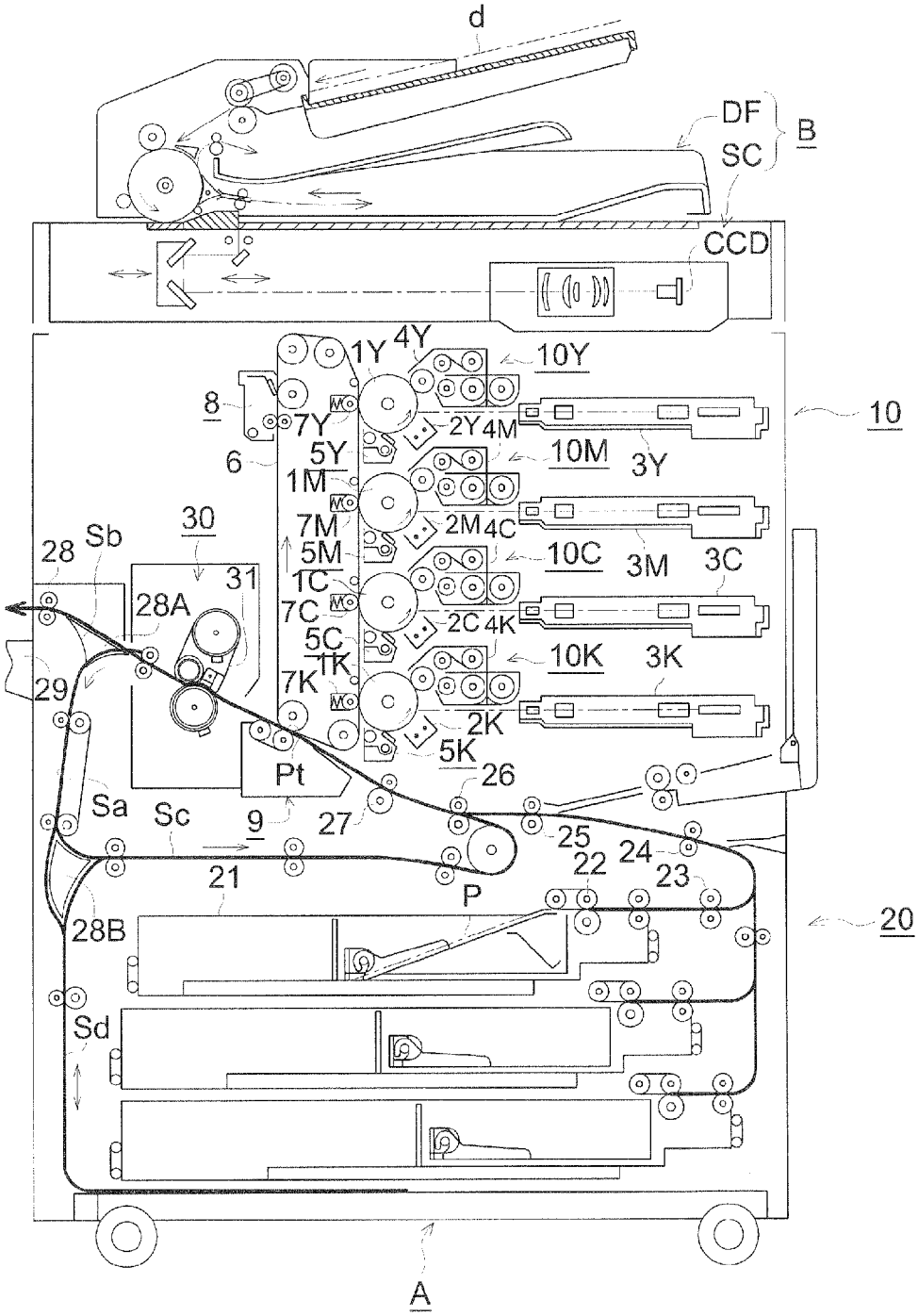
FIG. 1 is a sectional view showing a structure of image forming apparatus A relating to the present invention.

FIG. 1 is a sectional view showing a structure of image forming apparatus A relating to the present invention.

Image forming apparatus A is provided with image reading apparatus B placed at the upper portion of the body of image forming apparatus A.

Image forming apparatus A is referred to as a tandem type color image forming apparatus, and comprises image forming section 10 for forming a toner image of plural colors on intermediate transfer body 6, and then transfers the toner image onto sheet P to form a toner image on sheet P; sheet feeding section 20 for feeding and conveying sheet P to image forming section 10; and fixing device 30 for fixing the toner image formed on sheet P, onto sheet P.

Original document d placed on a document placement table is scanning exposed by a scanning exposure optical system of image reading device SC, and the image is transferred onto line image sensor CCD. Line image sensor CCD photoelectrically converts the transferred image to create the manuscript data, yellow (Y), magenta (M), cyan (C), and black (K), which data are then transferred to image processing section IP.

The manuscript data of each color are subjected to analogue processing, A/D conversion, shading compensation, image-encoding processing, or the like, in non-illustrated image processing section IP, and then temporarily stored in non-illustrated image memory section IM.

Next, the original manuscript data of each color stored in image memory section IM are input, based on a printing instruction of the original manuscript, in exposure section 3Y, 3M, 3C, and 3K for each color, each of which is contained in image forming section 10.

Image forming section 10 comprises yellow image forming unit 10Y for forming a yellow toner image on intermediate transfer body 6, and, in a similar way, magenta image forming unit 10M for forming a magenta image, cyan image forming unit 10C for forming a cyan toner image, black image forming unit 10K for forming a black toner image, and a secondary transfer section for transferring each colored toner image on intermediate transfer body 6 onto sheet P.

Yellow image forming unit 10Y is structured of photoreceptor 1Y, charging section 2Y which is disposed around photoreceptor 1Y, exposing section 3Y, developing section 4Y, photoreceptor cleaning section 5Y, and primary transfer section 7Y. Charging section 2Y and exposing section 3Y, corresponding to yellow manuscript data, form an electrostatic latent image on photoreceptor 1Y. Developing section 4Y accommodates a two-component developer composed of yellow toner and carrier, and develops the electrostatic latent image using the two-component developer to form a yellow toner image on photoreceptor 1Y.

Primary transfer section 7Y is disposed downstream of developing section 4Y, and transfers the yellow toner image formed on photoreceptor 1Y onto intermediate transfer body 6. Photoreceptor cleaning section 5Y removes the residual toner remaining on photoreceptor 1Y which was not transferred by primary transfer section 7Y, and restores photoreceptor 1Y to a state in which it can form an image again.

In a similar manner, magenta image forming unit 10M is structured of photoreceptor 1M, charging section 2M which is disposed around photoreceptor 1M, exposing section 3M, developing section 4M, primary transfer section 7M, and photoreceptor cleaning section 5M, and forms a magenta toner image on intermediate transfer body 6.

In the similar manner, cyan image forming unit 10C is structured by photoreceptor 1C, charging section 2C which is disposed around photoreceptor 1C, exposing section 3C, developing section 4C, primary transfer section 7C, and photoreceptor cleaning section 5C, and forms a cyan toner image on intermediate transfer body 6.

Further, black image forming unit 10K is structured of photoreceptor 1K, charging section 2K which is disposed around photoreceptor 1K, exposing section 3K, developing section 4K, primary transfer section 7K, and photoreceptor cleaning section 5K, and forms a black toner image on intermediate transfer body 6.

As described above, each colored toner image formed on each of photoreceptors 1Y, 1M, 1C, and 1K is successively transferred onto intermediate transfer body 6 by each of primary transfer section 7Y, 7M, 7C and 7K, and thereby a toner image composed of each colored toner is formed on intermediate transfer body 6.

Sheet feeding section 20 comprises sheet feed tray 21 accommodating sheet P; paper feed section 22 feeding sheet P accommodated in sheet feed tray 21; a plurality of conveying roller pair 23, 24, 25, 26 and registration roller conveying sheet P fed by paper feed section 22 to secondary transfer position Pt, and conveys sheet P to secondary transfer position Pt.

Secondary transfer section 9, as a transfer means, collectively transfers each colored toner image formed on intermediate transfer body 6, which is wound around a plurality of rollers and rotates via a non-illustrated driving section, onto sheet P at secondary transfer position Pt.

Intermediate transfer cleaning section 8 is disposed downstream of secondary transfer position Pt, and removes the residual toner remaining on intermediate transfer body 6 which was not transferred by secondary transfer section 9, and cleans intermediate transfer body 6 so that it can be used again.

Sheet P, on which a toner image composed of each colored toner is formed, is separated due to different radii of curvature and conveyed to fixing device 30. Fixing device 30 exerts heat and pressure on conveyed sheet P to fix the color image on sheet P.

Sheet feeding section 20 processes sheet P in a plurality of ways, which sheet was processed by fixing device 30.

The first way is that sheet P processed at fixing device 30 is directly conveyed to sheet discharge rollers 28 to be placed on sheet discharge tray 29 which is attached outside the apparatus main body.

The second way is the case where sheet P, having been fixed, is reversed and discharged, and then sheet P is conveyed to first conveying path Sa located downward by branching board 28A, and after that sheet P is reversely conveyed to make it pass through second conveying path Sb to discharge it outside the apparatus by sheet discharge rollers 28.

The third way is the case where an image is formed on both surfaces of sheet P, and then sheet P, on which an image is formed on the first surface and fixed, is conveyed to secondary transfer position Pt through both surfaces conveying path Sc which is structured by first conveying path Sa, third conveying path Sd and fourth conveying path Sc. Sheet P is conveyed with turning front to back of the sheet while sheet P goes through both surfaces conveying path Sc. Then, a toner image is formed on the second surface of sheet P at secondary transfer position Pt. After that, sheet P which was processed again by fixing device 30 is directly conveyed to sheet discharge rollers 28 to be placed on sheet discharge tray 29 which is attached outside the apparatus main body.

[Developing Section]

Figure 2:
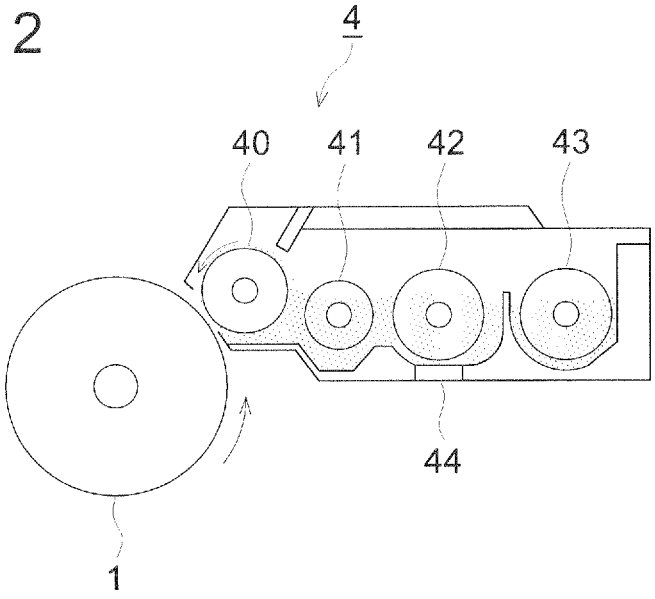
FIG. 2 is an expanded sectional view showing a structure of developing section 4Y, 4M, 4C, and 4K of each color which is disposed around photoreceptors 1Y, 1M, 1C, and 1K of each color.

FIG. 2 is an expanded sectional view showing a structure of developing sections 4Y, 4M, 4C, and 4K of each color, which is disposed around photoreceptors 1Y, 1M, 1C, and 1K of each color. Each of photoreceptor cleaning sections 5Y, 5M, 5C, and 5K has an identical configuration, and developing sections 4Y, 4M, 4C, and 4K of each color has also an identical configuration, and therefore symbols Y, M, C, and K are omitted in the following descriptions, and the photoreceptor cleaning sections and the developing sections are referred to as photoreceptor 1 and developing section 4, respectively.

Developing section 4 comprises developing roller 40 as a developer carrier which carries a two-component developer containing nonmagnetic toner and magnetic carrier; and developer storage unit 46 which is disposed near developing roller 40 and stores the two-component developer, and develops the electrostatic latent image on photoreceptor 1 to form a toner image.

Developing roller 40 is constituted of a magnetic roller fixedly arranged inside thereof and a sleeve made of aluminum which was subjected to thermal spraying with stainless steel by rotating the circumference of the magnetic roller. The outer diameter of developing roller 40 is 50 mm ϕ, the linear velocity (Vs) is 1,140 mm/s, and the linear velocity ratio (Vs/Vp) to photoreceptor 1 is 2.

Developing roller 40 is disposed away from photoreceptor 1 by a prescribed gap, and in this embodiment, a contact developing system is used, in which the developer on developing roller 40 makes contact with photoreceptor 1, but the embodiment is not limited to the contact developing system and a non-contact developing system may be used.

Stirring screws 42 and 43 accelerate the charged amount of toner in a two-component developer, and increase the charged amount of toner by rubbing mutually between the toner supplied from a non-illustrated toner supply unit and carrier.

Stirring paddle 41 is disposed between developing roller 40 and stirring screw 42, and accelerates an exchange between developer around developing roller 40 and developer around stirring screw 42, and thereby supplies the developer circulating through stirring screws 42 and 43 to developing roller.

Toner density sensor TS detects the magnetic permeability of the developer near the detection surface, and, as a result, detects the toner density in the developer. Then, based on the detection signal of toner density sensor TS, new toner is supplied from the toner supply unit, and thereby the density of the developer in developer storage unit 46 is maintained at the prescribed density.

As a non-magnetic toner, usable is polymerized toner having a volume-average particle size of 3 to 9 μm. As carrier, carrier having a ferrite core composed of magnetic particles having a volume-average particle size of 30 to 65 μm, and the amount of magnetization of 20 to 70 emu/g, can be used.

[Photoreceptor Cleaning Section]

Figure 3:
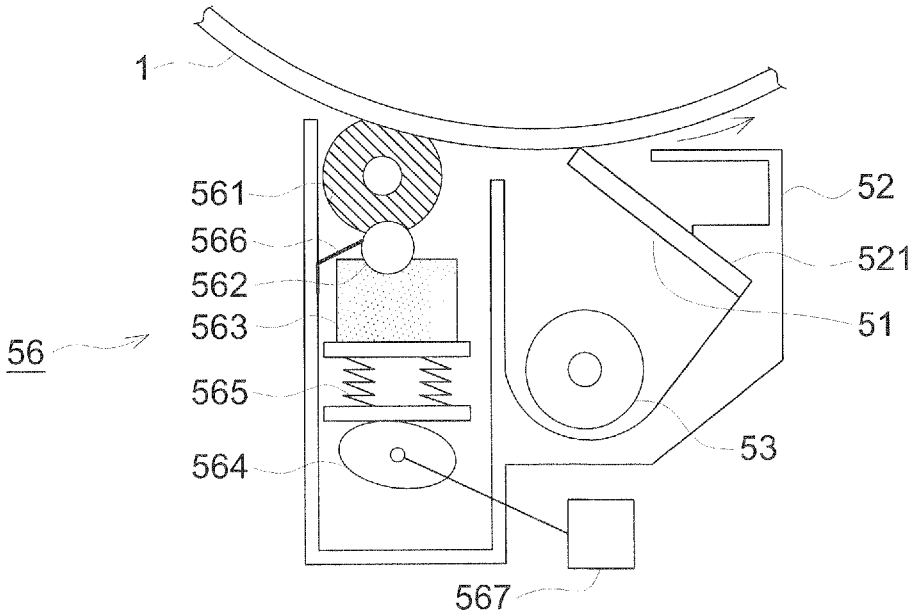
FIG. 3 is an expanded sectional view showing a structure of photoreceptor cleaning section 5Y, 5M, 5C, and 5K which are disposed around photoreceptors 1Y, 1M, 1C, and 1K of each color.

FIG. 3 is an expanded sectional view showing a structure of photoreceptor cleaning section 5Y, 5M, 5C, and 5K which are disposed around photoreceptors 1Y, 1M, 1C, and 1K of each color.

Since each of photoreceptor cleaning section 5Y, 5M, 5C, and 5K has an identical configuration, the photoreceptor cleaning section is referred to as photoreceptor cleaning section 5, and symbols Y, M, C, and K are omitted in the following descriptions.

Photoreceptor cleaning section 5 comprises cleaning blade 51 and lubricant applying section 56 which applies a solid lubricant to photoreceptor 1 in order to suppress wear of photoreceptor 1 caused by cleaning blade 51. Cleaning blade 51 scrapes together and removes residues such as toner remaining on photoreceptor 1 after the image was transferred, and is made of an elastic rubber body such as urethane rubber. Lubricant applying section 56 is disposed upstream of the rotation direction of photoreceptor 1 with respect to cleaning blade 51, and comprises brush roller 561, intermediate roller 562, lubricant supply body 563, cam 564, and coil spring 565.

Brush roller 561 is preferably a roller in which an electrically conductive fiber brush is formed on a roller made of aluminum or the like, and applies lubricant K to photoreceptor 1 as well as supplementarily removes residue on photoreceptor 1. Further, it is preferable that a voltage having a polarity opposite to the toner charge on photoreceptor 1 is applied to brush roller 561, or brush roller 561 is grounded.

Intermediate roller 562 scrapes off lubricant K from lubricant supply body 563 and applies it to brush roller 561. Further, intermediate roller 562 removes toner or the like from brush roller 561, and toner or the like on brush roller 561 is removed by scraper 566 made of PET film or the like.

Lubricant supply body 563 is a solid lubricant in block form. The back of lubricant supply body 563 is urged by coil spring 565, which surface is then scraped off by being pressed against intermediate roller 562, and lubricant K is supplied onto intermediate roller 562.

Pressure switching section 567 is connected to cam 564, changes the rotation angle of cam 564, and changes the pressing force to make it possible to control the supplied quantity of solid lubricant which is applied to photoreceptor 1.

The lubricant K is applied onto the surface of the photoreceptor for the purpose of mainly improving the cleaning property, and is in general composed of a metal salt of fatty acid. Specific examples of the lubricant include; a metal salt of stearic acid such as zinc stearic acid, aluminum stearic acid, copper stearic acid, and magnesium stearic acid; a metal salt of oleic acid such as zinc oleic acid, manganese oleic acid, iron oleic acid, copper oleic acid, and magnesium oleic acid; a metal salt of palmitic acid such as zinc palmitic acid, copper palmitic acid, and magnesium palmitic acid; a metal salt of linoleic acid such as zinc linoleic acid; and a metal salt of ricinoleic acid such as zinc ricinoleic acid, and lithium ricinoleic acid. Zinc stearic acid is particularly preferable.

[Intermediate Transfer Cleaning Section as a Cleaning Means]

Figure 4:
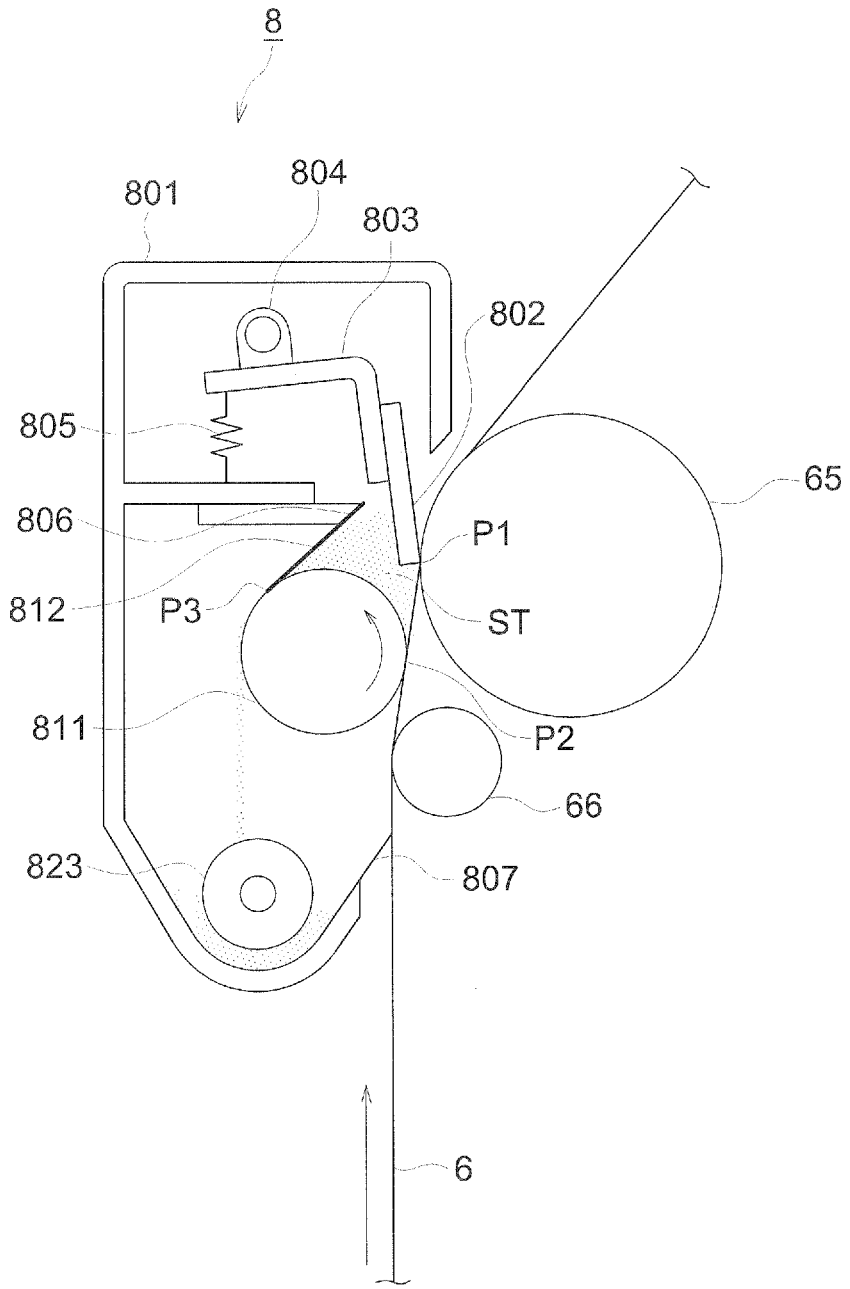
FIG. 4 is an expanded sectional view showing a structure of intermediate transfer cleaning section 8 as the cleaning means relating to the present invention.

FIG. 4 is an expanded sectional view showing a structure of intermediate transfer cleaning section 8 as the cleaning means relating to the present invention.

Numeral 801 is a casing, on which each member composing intermediate transfer cleaning section 8 is attached, and comprises a storage unit which accommodates toner removed from intermediate transfer body 6.

Cleaning blade 802 is made of an elastic body such as urethane rubber, and is fixed to blade holder 803 with an adhesive or the like.

Blade holder 803 is rotatably installed on blade supporting shaft 804 arranged at casing 801.

Pressing spring 805 urges blade holder 803 counter-clockwise as shown in the figure around blade supporting shaft 804. The tip of cleaning blade 802 makes close contact with intermediate transfer body 6 at pressing position P1 facing the reverse direction of rotation of intermediate transfer body 6.

Sponge roller 811 is disposed upstream of pressing position P1 in the rotation direction of intermediate transfer body 6, and makes close contact with intermediate transfer body 6 which is stretched and supported by tension roller 66 at close contact position P2 shown in the figure. Sponge roller 811 is driven in the same direction as intermediate transfer body 6 by a non-illustrated driving section so that the circumferential speed thereof is higher than that of intermediate transfer body 6.

Toner discharge control member 812 is made of a sheet of PET, and an edge thereof makes close contact with the surface of sponge roller 811 at close contact point P3 on the opposite side of close contact position P2, and the other edge is adhered and fixed with double-sided adhesive tape or the like to supporting part 806 of casing 801.

Storage space ST is a space which is defined, as shown in figure, by intermediate transfer body 6, sponge roller 811, and toner discharge control member 812, and is formed upstream of the pressing position P1 in the rotation direction of intermediate transfer body 6, and therefore is fully capable of storing toner removed by cleaning blade 802. A part of toner stored in storage space ST is supplied to intermediate transfer body 6 as a solid lubricant, and restrains the lip of cleaning blade 802 and the wear of intermediate transfer body 6. Toner discharge control member 812 is made of an elastic PET sheet, and has a function to increase the toner discharged from close contact point P3 according to an increase in the toner stored in storage space ST, and thereby a quantity of toner larger than a predetermined amount is continually kept in storage space ST.

As described above, since a proper amount of toner as a solid lubricant is continually supplied to the tip of cleaning blade 802, prevention of wear of intermediate transfer body 6 and the lip of cleaning blade 802 is made possible without applying lubricant K to intermediate transfer body 6 like that used in the photoreceptor cleaning section 5. In addition, occurrence of image failure such as transfer unevenness due to the fact that lubricant K excessively adheres locally to intermediate transfer body 6 is prevented.

[Control Section]

Figure 5:
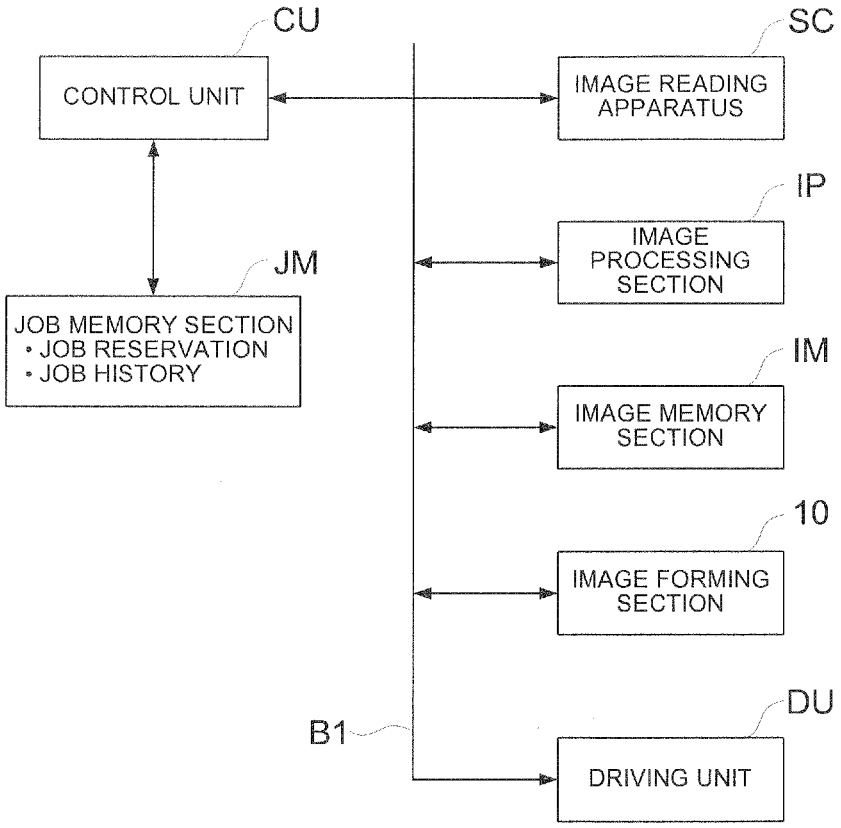
FIG. 5 is a block diagram showing a major portion involving control unit CU relating to the present invention.

FIG. 5 is a block diagram showing a major portion involving control unit CU relating to the present invention. As shown in the figure, control section CU controls image forming apparatus A in an integral fashion in communication, via bus BS, with image reading device SC, image processing unit IP, image memory unit IM, image forming section 10, driving unit DU, job memory section JM, or the like.

Driving unit DU has a driving circuit which drives a non-illustrated motor, clutch, or the like which are incorporated in a driving mechanism of photoreceptors 1Y, 1M, 1C, and 1K and intermediate transfer body 6, and sets rotation/stop, reverse rotation, or speed of photoreceptors 1Y, 1M, 1C, and 1K and intermediate transfer body 6 according to instructions of control unit CU.

Job memory section JM stores job information of a reserved printing job, an executed printing job, and contents of jobs thereof. Image memory unit IM stores, in equivalence with the job information, printing data of a reserved printing job and image data (bitmap data) which will be processed at image forming section 10.

For example, control unit CU, after job memory section JM reads out stored job information, obtains the action mode of previous printing job OPJ which was carried out prior to current printing job CPJ, and determines whether or not previous printing job OPJ immediately before current printing job CPJ is intermittent printing which is operated in an intermittent mode, and further determines the repeating situation of intermittent printing.

[Generation Mechanism of Cleaning Failure]

There will be detailed below a problem in which cleaning failure occurs prior to a regular cleaning action of the cleaning blade is carried out, if continuous printing with a long continuous rotation time of intermediate transfer body 6 is carried out after intermittent printing.

The inventors found that an excessive transfer of lubricant K from each photoreceptor 1 onto intermediate transfer body 6 during intermittent printing has a relationship with the above cleaning problem, and clarified the generation mechanism in which the cleaning failure occurs.

Figure 6A:
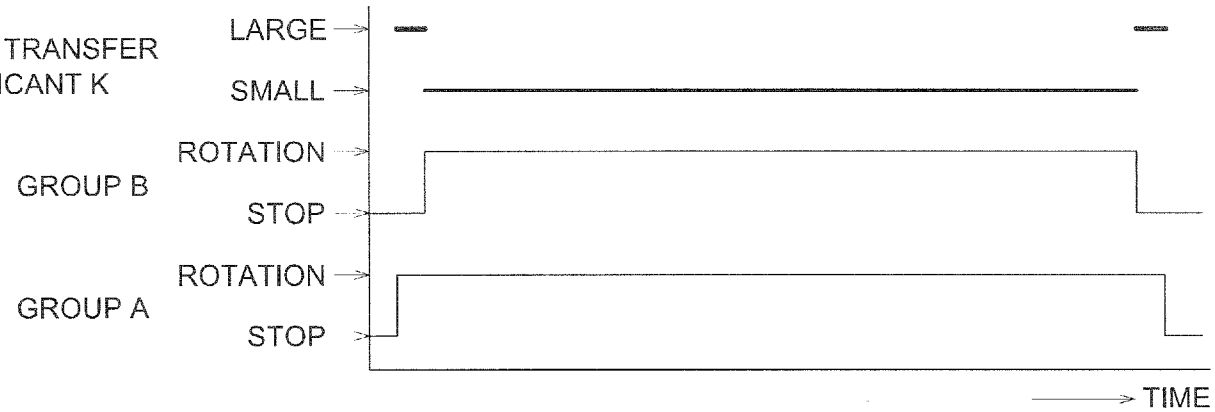
FIGS. 6*a* and 6*b* are schematic illustrations showing a relationship between rotating state of photoreceptor 1 and developing roller 40 of each color and the amount of transfer of lubricant K which is transferred onto intermediate transfer body 6, during continuous printing and intermittent printing, respectively.
Figure 6B:
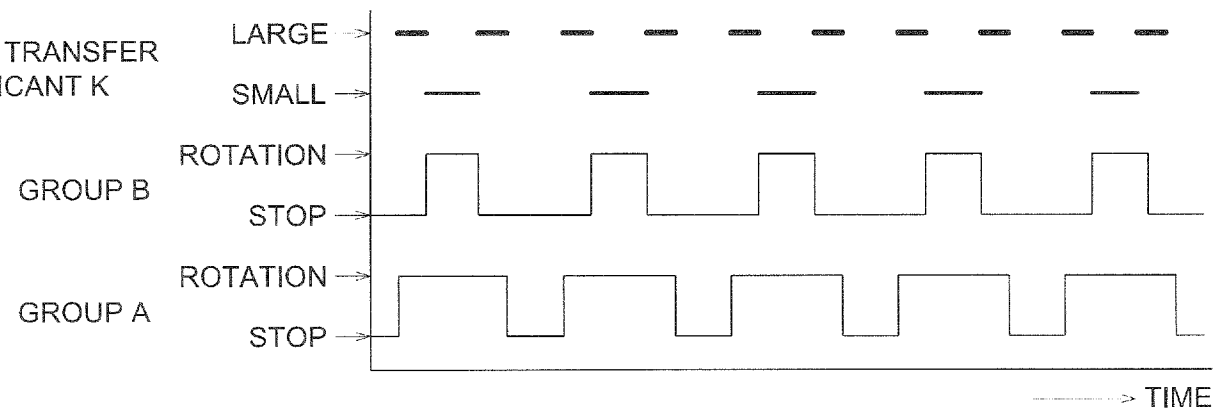

FIGS. 6*a* and 6*b* are timing charts showing a relationship between a rotating state of photoreceptor 1 of each color (intermediate transfer body 6) and developing roller 40 and the amount of transfer of lubricant K which is transferred onto intermediate transfer body 6, during continuous printing and intermittent printing, respectively.

Intermittent printing means a job in which developing section 4 has a high stop rate during rotation of intermediate transfer body 6 and is a short job in which, for example, the number of sheets processed at a time is one or several sheets. The continuous printing means one in which the above stop rate is low, and is a long job in which, for example, the number of sheets processed at a time is from several hundreds or more to several thousands.

FIG. 6*a* is a timing chart of continuous printing, and FIG. 6*b* is a timing chart of intermittent printing in the case where one sheet printing job is repeatedly and continuously carried out Group A indicates a rotating state (rotation or stop) of photoreceptor 1 and intermediate transfer body 6, and group B indicates a rotating state of developing roller 40. The "transfer of lubricant K" indicates a state of the amount of transfer of lubricant K from photoreceptor 1 to intermediate transfer body 6, and "large" and "small" indicate states that the amount of transfer of lubricant K is large and small, respectively.

Lubricant K is applied (supplied) onto rotating photoreceptor 1 by lubricant application section 56, which lubricant K is then removed by contact with a developer carried on rotating developing roller 40, and therefore, during rotation of developing roller 40, some of lubricants applied onto photoreceptor 1 are transferred to developing roller 40 without being transferred to intermediate transfer body 6 due to scratch between photoreceptor 1 and developer on developing roller 40. Due to the reason, the amount of lubricant K which has been applied on photoreceptor 1 (the amount of lubricant K which will be transferred to intermediate transfer body 6) is small during rotation of developing roller 40, and is large during stop of developing roller 40.

Since photoreceptor 1 of each color rotates at just the right moment with intermediate transfer body 6, as is indicated in FIGS. 6*a* and 6*b* in which both are grouped in group A, and the both are brought into close contact to each other by primary transfer section of each color, the amount of transfer of lubricant K to intermediate transfer body 6 changes according to the amount of lubricant K having been applied onto photoreceptor 1.

As is shown in FIG. 6*a*, since developing roller 40 in group B is rotated at just the right moment with photoreceptor 1 during continuous printing so as not to cause an influence of load change during rotation, the condition of a large amount of application of lubricant K onto photoreceptor 1, that is, the condition of a large amount of transfer of lubricant K onto intermediate transfer body 6 occurs only twice, at the start and at the end of the continuous printing. For example, the condition of a large amount of transfer of lubricant K occurs twice in the printing process of about several hundreds to about several thousands of sheets, and the amount of transfer of lubricant K is small in most of the printing process.

As is shown in FIG. 6*b*, since developing roller 40 is allowed to rotate immediately before an image on photoreceptor 1 passes through, and is allowed to stop immediately after the image passed through, during intermittent printing in which start and stop of rotation of intermediate transfer body 6 and developing roller 40 are repeated, the condition of a large amount of transfer of lubricant K transferred onto intermediate transfer body 6 occurs before and after each printing job (previous printing job ORJ) in intermittent printing. For example, the condition of a large amount of transfer of lubricant K occurs twice since start and stop of operation are carried out at every one to several sheets. Therefore, as is illustrated, a ratio, in which the condition of a large amount of transfer of lubricant K occurs with respect to rotation amount (rotation distance) L of intermediate transfer body 6, becomes significantly large compared to that during continuous printing. In other words, since, during intermittent printing, the stop ratio of developing section 4 during the rotation of intermediate transfer body 6 is high, and thereby the amount of transfer of lubricant K being transferred from photoreceptor 1 to intermediate transfer body 6 is large, lubricant K is excessively applied onto intermediate transfer body 6 after intermittent printing continued over a long period of time.

Figure 7A:
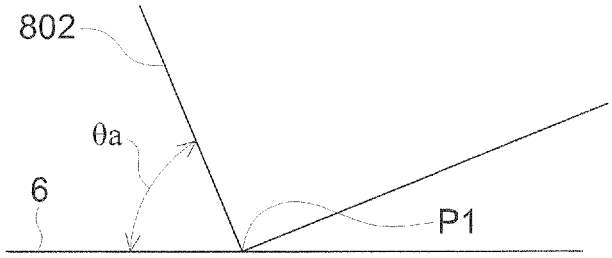
FIGS. 7*a*, 7*b*, and 7*c* are schematic illustrations showing the edge configuration of cleaning blade 802 being pressure contacted to intermediate transfer body 6.
Figure 7B:
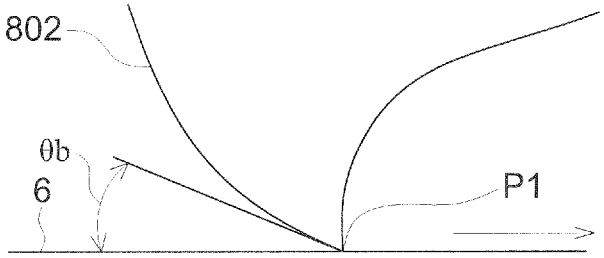
Figure 7C:
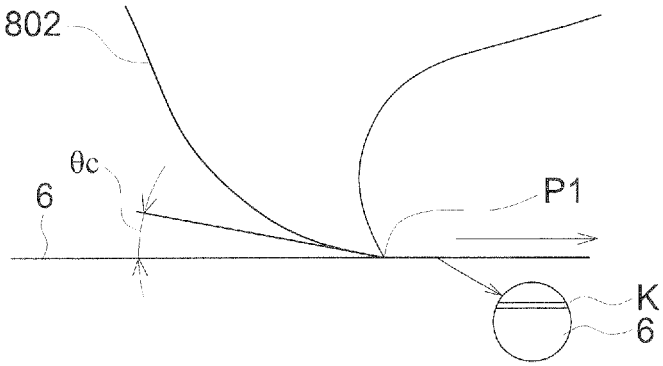

FIGS. 7*a*, 7*b*, and 7*c* are schematic illustrations showing the configuration of cleaning blade 802 being pressure contacted to intermediate transfer body 6.

FIG. 7*a* is a schematic illustration showing a configuration of cleaning blade after intermediate transfer body 6 was allowed to stop, and FIGS. 7*b* and 7*c* are schematic illustrations showing configurations of cleaning blade during rotation of intermediate transfer body 6.

On intermediate transfer body 6 of FIG. 7*b*, no lubricant K exists, while on intermediate transfer body 6 of FIG. 7*c*, lubricant K is applied.

The edge of cleaning blade 802 is pulled downstream by sliding force due to the rotation of intermediate transfer body 6, and as a result cleaning blade 802 is deformed into configurations like FIGS. 7*b* and 7*c*. When cleaning blade 802 stops, it returns to a configuration like in FIG. 7*a*. When the rotation of intermediate transfer body 6 stops, intermediate transfer body 6, near pressing position P1, rotates in the upstream direction (in the reverse direction), and then cleaning blade 802 returns to a configuration as in FIG. 7*a*.

θa, θb, and θc are crossing angles (a tentative name) in which an edge face on the tip of cleaning blade 802 and intermediate transfer body 6 cross each other. θa is tentatively referred to as the initial crossing angle, and θb and θc are tentatively referred to as the crossing angle at work.

The edge of cleaning blade 802 is pulled downstream by sliding force of intermediate transfer body 6, and the edge configuration gradually increases in deformation as time advances, and then the crossing angles at work θb and θc gradually become smaller. It is assumed that the edge configuration changed from the configuration of FIG. 7*a* to FIGS. 7*b* and 7*c*.

As is indicated by a relationship θb>θc, in the case where lubricant K is applied to intermediate transfer body 6, the sliding force of intermediate transfer body 6 against cleaning blade 802 is increased compared to the case where no lubricant K is applied. In addition, according to the amount of application of lubricant K, the sliding force due to intermediate transfer body 6 is increased. Therefore, the crossing angle at work θc becomes smaller according to the amount of application of lubricant K on intermediate transfer body 6.

Lubricant K on intermediate transfer body 6 is taken up by sheet P for each sheet passed in the sheet passage area, and gradually decreases due to repeat of the passage of sheets of paper. The amount of the lubricant being taken up depends on the type of the sheet of paper, and for example the amount is large for smooth paper.

Furthermore, once rotation of intermediate transfer body 6 is initiated, the edge configuration of cleaning blade 802 may be changed to increase the deformation over time, but it is not changed to decrease it. Therefore, the change over time of the crossing angle at work θc at each part in the main scanning direction is determined by the amount of application of lubricant K at initiation of rotation, the type or size of sheet P being passed through, or the like.

When the rotation of intermediate transfer body 6 is initiated and crossing angle at work θc gradually decreases to less than or equal to the critical angle θr, the part of toner supplied from storage space ST onto intermediate transfer body 6 squeezes under the edge of cleaning blade 802 to cause image stain on sheet P. Namely, it is assumed that cleaning failure has occurred.

As was described above, compared to a case where a regular printing job (including continuous printing) was carried out, in the case where intermittent printing, in which the stop ratio of developing section 4 during the rotation of intermediate transfer body 6 is high, continued over along period of time, the amount of transfer of lubricant K to be transferred from photoreceptor 1 to intermediate transfer body 6 is large. Therefore, it is assumed that crossing angle at work θc of cleaning blade 802 becomes less than critical angle θr prior to the regular return action of cleaning blade configuration is carried out in the continuous printing immediately after intermittent printing, and then cleaning failure occurs.

[Countermeasure Against Cleaning Failure]

Next, a "measure to prevent cleaning failure caused by transfer of lubricant K", relating to the present invention, will be detailed.

Figure 8:
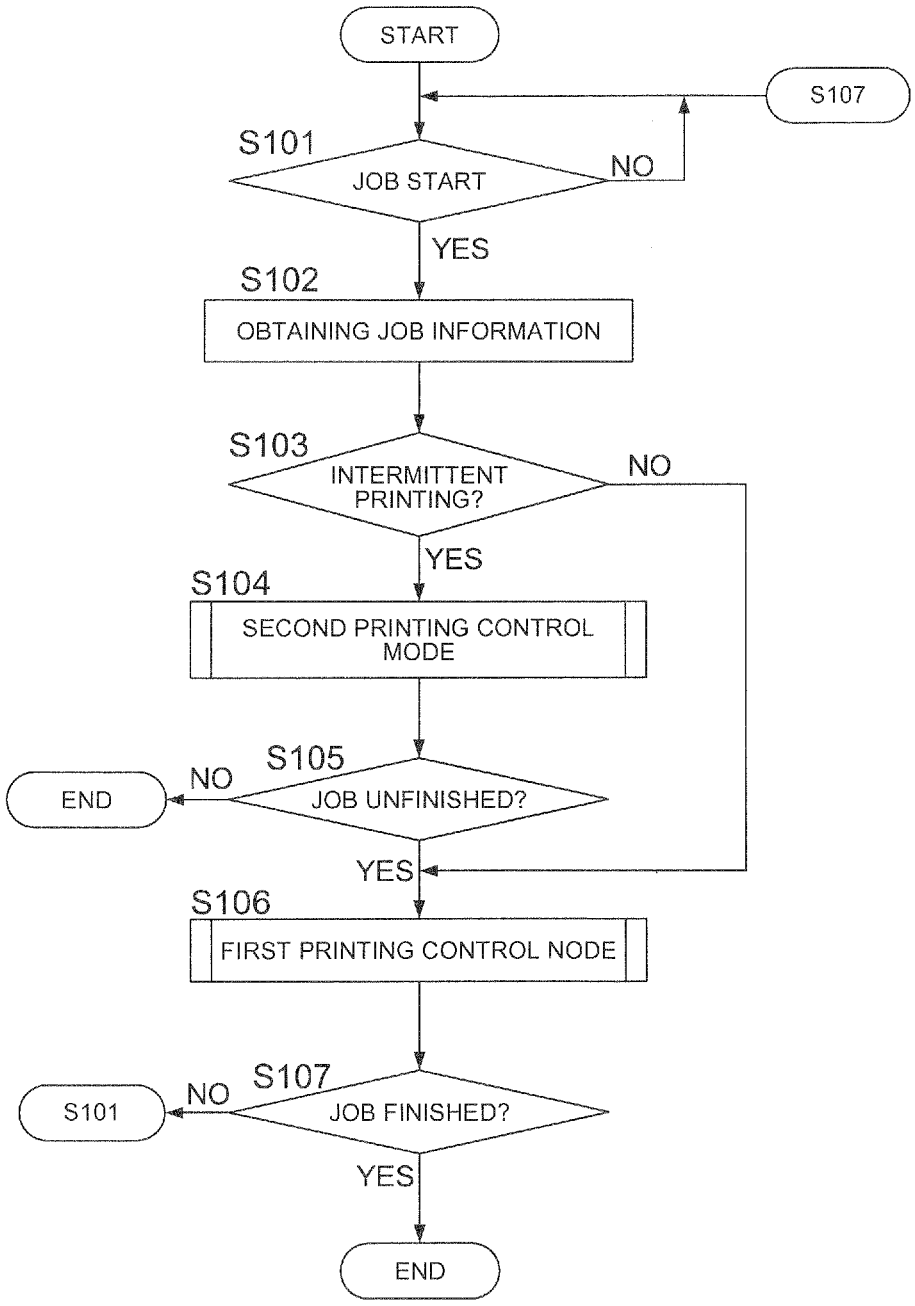
FIG. 8 is a flowchart showing an embodiment of a control to prevent cleaning failure relating to the present invention, which is managed by control unit CU.

FIG. 8 is a flowchart showing an embodiment of a control to prevent cleaning failure relating to the present invention, which is managed by control unit CU.

S101 is a step to determine the start or resumption of a printing job. When the start of the printing job is determined, the procedure goes to step S102.

S102 is a step to read out contents of reserved printing job information (job reservation) and printed printing job information (job history) from job memory section JM, and to obtain job information of the plurality of previous printing jobs OPJ which were carried out prior to current printing job CPJ. Next, the procedure goes to step S103.

S103 is a step to determine whether or not the plurality of previous printing jobs OPJ obtained at step S102 are intermittent printing.

In the case where the determination result is intermittent printing (in the case of Yes), the procedure goes to step S104, and in the case where the determination result is not intermittent printing (in the case of No), the procedure goes to step S106.

S104 is a step of the second printing control mode in which, when rotation length L, as the rotation amount of intermediate transfer body 6, reaches second predetermined value $R_2$ while allowing the printing to progress, S104 carries out an additional return action of cleaning blade configuration to prevent cleaning failure caused by transfer of lubricant K.

Rotated distance L is a distance (m) in which intermediate transfer body 6 continuously rotated from after initiation of rotation to an optional point of time without producing return action of blade configuration (refer to FIGS. 7*a*, 7*b*, and 7*c*), but it is not limited to the rotated distance, and variables being possible to correspond to rotated distance L of intermediate transfer body 6 are also covered. For example, the number of sheets being subjected to printing, the operating time of intermediate transfer body 6, or the like corresponds to rotated distance L of intermediate transfer body 6.

Figure 9:
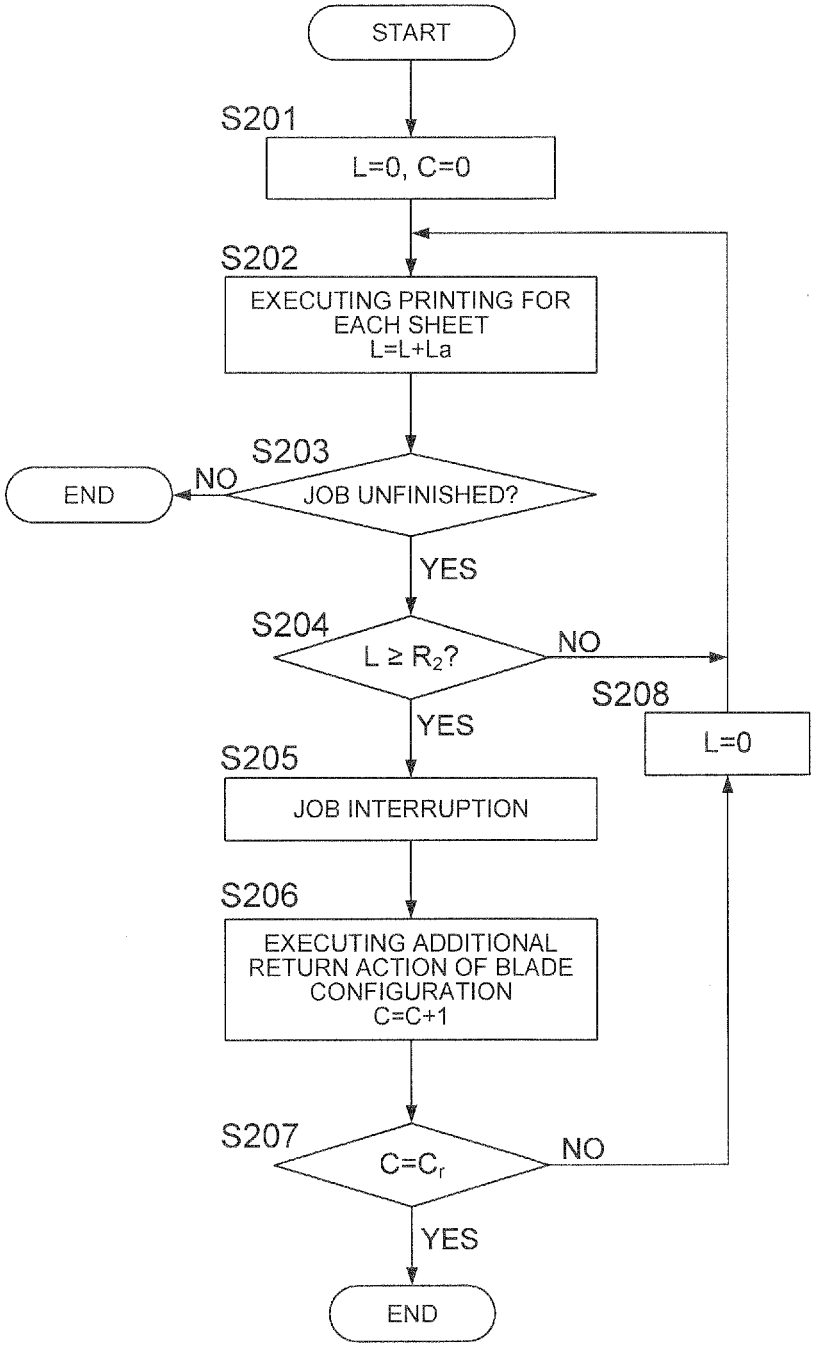
FIG. 9 is a flowchart showing the structure of the first printing control mode carrying out a regular return action of the cleaning blade configuration.

FIG. 9 is a flowchart showing the structure of the second printing control mode carrying out an additional return action of cleaning blade configuration relating to the present invention.

S201 is a step to initialize rotated distance L of intermediate transfer body 6 and the number of executions C of return action of cleaning blade configuration, namely to reset L and C. After that, the procedure goes to step S202.

S202 is a step to execute printing for each sheet P having been passed through according to a printing job, and updates rotated distance L of intermediate transfer body 6, that is to calculate L=L+La. La is rotated distance L in which intermediate transfer body 6 rotates per sheet.

Next, S203 is the step to determine whether or not the printing job is unfinished. In the case of unfinished (in the case of Yes), the procedure goes to step S204, and in the case of finished (in the case of No), the second printing control mode is finished.

S204 is the step to determine whether or not rotated distance L of intermediate transfer body 6 is more than or equal to second predetermined value $R_2$, and in the case where L is more than or equal to second predetermined value $R_2$ (in the case of Yes), the procedure goes to steps S205 and S206. In the case where L is less than second predetermined value $R_2$ (in the case of No), the procedure goes back to step S202, and then steps S202 to S204 are repeated.

Control unit CU, if it is determined to be Yes at step S204, interrupts currently running printing job CPJ (S206).

S206 is the step to execute an additional return action of cleaning blade configuration to stop the rotation of intermediate transfer body 6, and to update the number of the above execution C. Specifically, S206 controls driving unit DU, stops the rotation of intermediate transfer body 6, executes an action to return the configuration of cleaning blade 802 to the state shown in FIG. 7*a*, and carries out an arithmetic processing of C=C+1. Then, the procedure goes to step S207.

Second predetermined value $R_2$ is set in advance, and is a reference value which determines an execution timing of an additional return action of blade configuration to prevent the occurrence of the cleaning failure due to the transfer of lubricant K. Second predetermined value $R_2$ is different from first predetermined value $R_1$ which determines an execution timing of a regular return action of blade configuration to prevent the occurrence of the lip of the blade caused by foreign matter or the like or a cleaning failure, and $R_2$ and $R_1$ have a relation of $R_2<R_1$.

S207 is a step to determine whether or not the number of executions C of an additional return action of cleaning blade configuration reached the reference number of times $C_T$ being set in advance. Namely, S207 determines whether or not C and $C_T$ have the relationship $C=C_Y$.

In the step S207, if it is determined that $C \neq b\ C_T$ (No), the procedure goes to step S208, and rotated distance L of intermediate transfer body 6 is reset. And then, returning to step S202, the steps from S202 to S207 are repeated until C and $C_T$ have the relationship $C=C_T$.

In S207, if it is determined that $C=C_T$ (Yes), second printing control mode to carry out an additional return action of blade configuration is stopped.

Returning to FIG. 8, the above procedure is described. After the step of the second printing control mode, the procedure goes to step S105.

S105 is a step to determine whether or not the printing job is unfinished, and in the case of unfinished (in the case of Yes), the procedure goes to step S106, and in the case of finished (in the case of No), the control itself is finished.

S106 is a step of the first printing control mode in which, when rotation length L as the rotation amount of intermediate transfer body 6 reaches the first predetermined value $R_1$ while allowing the printing to progress, S106 carries out only a regular return action of cleaning blade configuration to prevent the lip of the blade caused by foreign matter or the like, or cleaning failure.

Figure 10:
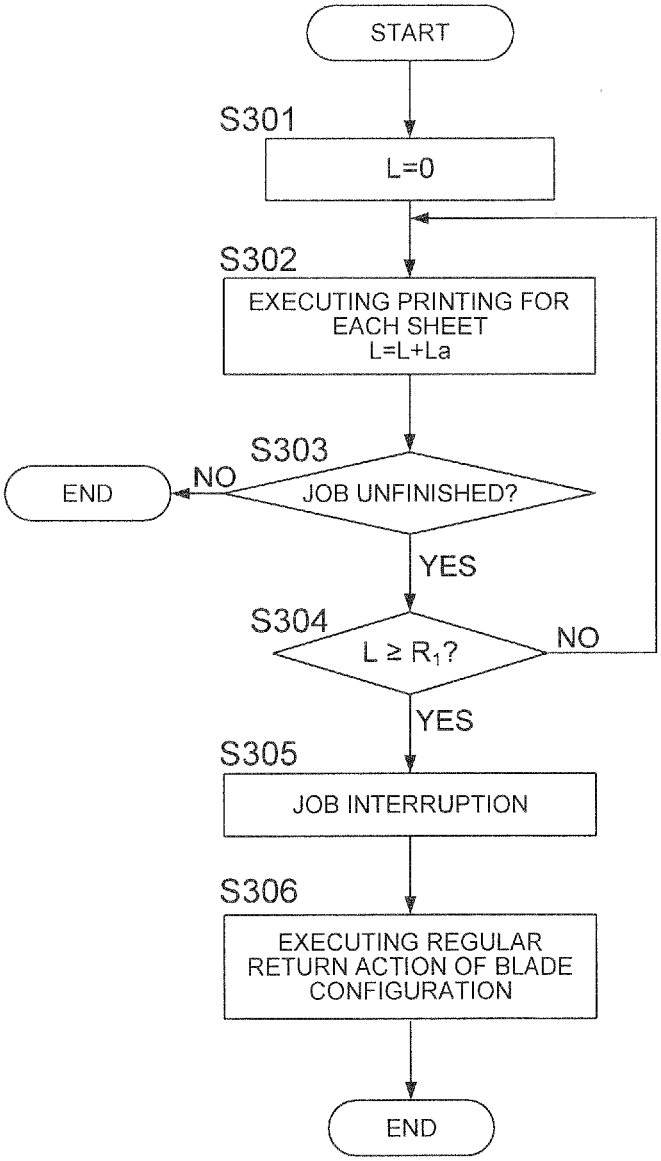
FIG. 10 is a flowchart showing the structure of the first printing control mode carrying out a regular return action of cleaning blade configuration.

FIG. 10 is a flowchart showing the structure of the first printing control mode carrying out a regular return action of cleaning blade configuration, which will be described below.

S301 is a step to reset rotated distance L of intermediate transfer body 6, and after the processing, the procedure goes to step S302.

S302 is the step to carry out printing for each sheet P having been passed through according to the printing job, and to update rotated distance L of intermediate transfer body 6.

S303 is the step to determine whether or not the printing job is unfinished. In the case of Yes (that is the printing job is unfinished), the procedure goes to step S304, and in the case of No, the first printing control mode is finished and the procedure goes to step S107 of FIG. 8.

S304 is the step to determine whether or not rotated distance L of intermediate transfer body 6 is more than or equal to first predetermined value $R_1$. In the case of less than first predetermined value $R_1$ (in the case of No), the procedure goes back to S301, and then the steps from S301 to S304 are repeated until rotated distance L of intermediate transfer body 6 reaches a value more than or equal to first predetermined value $R_1$. And then, when the value is determined to be more than or equal to first predetermined value $R_1$ (when determined to be Yes), the currently running job is interrupted (step S305), and the procedure goes to step S306.

S306 is the step to carry out a regular return action of cleaning blade configuration, and the series of first printing control mode is finished, and then the procedure goes to step S107 of FIG. 8.

Returning to FIG. 8, the above description is continued.

S107 is the step to determine whether or not the printing job is unfinished. In the case of unfinished (in the case of No), the procedure goes back to step S101, and the series of steps are repeated until the printing job is finished.

But since the second run, the plurality of previous printing jobs which were carried out prior to current printing job CPJ are continuous printing jobs interrupted by return action of cleaning blade configuration, and the determination result at step S103 is not intermittent printing but becomes "No", and therefore, only the first printing control mode is repeated until the printing job is completed.

As was described above, in the case where continuous printing is carried out after intermittent printing, control unit CU carries out the additional return action of cleaning blade configuration prior to the regular return action of cleaning blade configuration, based on predetermined second predetermined value $R_2$, or reference number of times $C_T$, and thereby it makes possible to surely prevent the occurrence of cleaning failure caused by transfer of lubricant K onto intermediate transfer body 6 before it happens.

Default values of second predetermined value $R_2$ and reference number of times $C_T$ at the time of their installation are rewritable by operations of operators, managers or the like, and it is possible to suitably set the values $R_2$ and $C_T$ in accordance with the usage environment of image forming apparatus A.

Embodiment (1) of Decision Control of Intermittent Printing

Embodiment (1) relating to a decision control of intermittent printing which is a control to determine "whether or not the plurality of previous printing jobs OPJ are intermittent printing," makes it possible to minimize the impact of productivity decline of the printing job, and will be detailed below.

Control unit CU determines, in step S103 of FIG. 8, whether or not the printing job is intermittent printing, based on job information on the plurality of previous printing jobs OPJ prior to current printing job CPJ.

In the plurality of previous printing jobs OPJ, as is shown in FIG. 6*b*, intermediate transfer body 6 and photoreceptor 1 stop between jobs, and at the start and stop of the job, a stop condition of developing section 4 is included.

Part 1;

Control unit CU calculates total intermittent coefficients D using a formula described below based on job information of the plurality of previous printing jobs OPJ which belong in an extent going back from just before current printing job CPJ by prescribed distance (prescribed amount) $L_b$ of rotation distance L of the above intermediate transfer body.

$$D=\Sigma D_j (j=1, 2, 3, \ldots) \quad \text{Formula (1):}$$

where, $D_j$ is an intermittent coefficient obtained based on the number of sheets P "n" which were passed through at each previous printing job OPJ; and D is a cumulative total value of intermittent coefficient $D_k$ in all over previous printing jobs OPJ.

Table 1 below is an example of a reference table which was registered in advance and relates the number of sheets P "n" which were passed through at one previous printing job OPJ to intermittent coefficient $D_j$.

TABLE 1

| The number of sheets n | Intermittent coefficient D |
|---|---|
| 1 | 5.0 |
| 2 | 2.5 |
| 3 | 1.7 |
| 4 | 1.3 |
| 5 | 1.0 |
| 6 or more | 0 |

Part 2;

Control unit CU determines the presence or absence of intermittent printing, based on total intermittent coefficients D obtained based on the number of sheets n, and further sets second predetermined value $R_2$ and the reference number of times $C_T$.

Table 2 described below is an example of a correspondence table showing a relationship of total intermittent coefficients D with a decision of intermittent printing or second predetermined value $R_2$ and reference number of times $C_T$.

TABLE 2

| Total intermittent coefficients D | Decision of intermittent printing | Second predetermined value $R_2$ | Reference number of times $C_r$, |
|---|---|---|---|
| D < 100 | Absence | — | — |
| 100 ≤ D < 200 | Presence | 100 m | 1 |
| 200 ≤ D < 300 | Presence | 100 m | 2 |
| 300 ≤ D | Presence | 100 m | 3 |

Control unit CU executes the additional return action of blade configuration according to total intermittent coefficients D, and after that, executes the regular return action of blade configuration. Therefore, in the case where previous printing jobs OPJ, which were carried out prior to current printing job CPJ, is single or a small repeating scale (repeating frequency) intermittent printing, D becomes D<100, and then previous printing jobs OPJ are not determined as intermittent printing relating to the present invention, and as a result, control unit CU does not execute the additional return action of blade configuration. Therefore, the productivity of the printing job is significantly improved.

Further, also in the case of being determined as intermittent printing based on total intermittent coefficients D, since the number of executions of the additional return action of blade configuration is controlled according to total intermittent coefficients D, the cleaning failure can be surely prevented and the above significant improvement of productivity can be achieved.

Embodiment (2) of Decision Control of Intermittent Printing

Embodiment (2) relating to a decision control of intermittent printing also makes it possible to minimize the impact of productivity decline of the printing job, and will be detailed below.

Control unit CU determines, in step S103 of FIG. 8, whether or not the printing job is intermittent printing, based on job information on the plurality of previous printing jobs OPJ prior to current printing job CPJ.

Part 1;

Control unit CU calculates intermittent rotation distance Φ using a formula described below based on job information of the plurality of previous printing jobs OPJ which belong in an extent going back from just before current printing job CPJ by prescribed distance $L_b$ of rotation distance L of the above intermediate transfer body.

$$\Phi=\Phi_1+\Phi_2 \quad \text{Formula (2):}$$

$$\Phi_1=\Sigma L_j \quad \text{Formula (3):}$$

$$\Phi_2=\Sigma S_j \quad \text{Formula (4):}$$

(j=1, 2, 3, . . . )

where, $L_j$ is a distance in which intermediate transfer body 6 rotated at each previous printing job OPJ; $S_j$ is a distance in which intermediate transfer body 6 rotated at each previous printing job OPJ during operation of developing section 4; $\Phi_1$ is a total distance in which intermediate transfer body 6 rotated at the plurality of previous printing jobs OPJ; and $\Phi_2$ is a total distance in which intermediate transfer body 6 rotated at the plurality of previous printing jobs OPJ during operation of developing section 4.

Intermittent rotation distance Φ corresponds to rotation distance L of intermediate transfer body 6 which rotates while directly contacting the surface of photoreceptor 1 on which lubricant K was applied by lubricant application section 56 in a larger amount than usual without being removed by developer on developing roller 40. In other words, intermittent rotation distance Φ relates to a contacted time in which rotating intermediate transfer body 6 directly contacted to the surface of photoreceptor 1 on which lubricant K was applied in a large amount.

Therefore, control unit CU may determine the presence or absence of intermittent printing based on intermittent rotation time T which is equivalent to the above contacted time, in place of intermittent rotation distance Φ, and further, may set second predetermined value $R_2$ and the reference number of times $C_T$.

Next, control unit CU determines whether or not the printing is intermittent printing based on calculated intermittent rotation distance Φ, and further sets second predetermined value $R_2$ and reference number of times $C_T$.

Table 3 is an example of a correspondence table showing a relationship of intermittent rotation distance Φ with a decision of whether or not the printing is intermittent printing or with second predetermined value $R_2$ and reference number of times $C_T$, and is shown below.

TABLE 3

| Intermittent rotation distance Φ | Decision of intermittent printing | Second predetermined value $R_2$ | Reference number of times $C_r$, |
|---|---|---|---|
| 1Φ < 100 | No | — | — |
| 100 ≤ Φ < 200 | Presence | 50 m | 1 |
| 200 ≤ Φ < 300 | Presence | 50 m | 2 |
| 300 ≤ Φ | Presence | 50 m | 3 |

The column of "Decision of intermittent printing" in Table 3 is a decision result whether or not the printing is intermittent printing, and the "No" means a result of "it is not intermittent printing" and "Presence" means a result of "it is intermittent printing."

As shown in an example of Table 3, control unit CU does not determine that the printing is intermittent printing relating to the present invention in the case where intermittent rotation distance Φ is less than 100 m. Namely, control unit CU does not execute the additional return action of blade configuration.

In the case where intermittent rotation distance Φ is more than or equal to 100 m, control unit CU determines that the printing is intermittent printing. However, in the case of 100≤Φ<200, control unit CU executes the additional return action of blade configuration at the point that rotation distance L of intermediate transfer body 6 reached 50 m. In the case of 200≤Φ<300, control unit CU executes one additional return action of blade configuration at each point that rotation distance L of intermediate transfer body 6 reached 50 m and 100 m, that is, for a total of two times. And in the case of 300≤Φ, control unit CU executes one additional return action of blade configuration at the point that rotation distance L of intermediate transfer body 6 reached 50 m, 100 m, and 150 m, that is, for a total of three times.

As was described above, even if intermittent printing was executed in previous printing jobs OPJ prior to current printing job CPJ, control unit CU does not execute the additional return action of blade configuration, in the case where the previous printing job is single or a small repeating scale, because excessive lubricant K is not transferred onto intermediate transfer body 6. Alternatively, control unit CU finely controls the execution of the additional return action of blade configuration according to intermittent rotation distance Φ. For that reason, it makes possible to surely prevent the cleaning failure caused by the transfer of lubricant K and to significantly improve the productivity of the printing jobs.

Control unit CU determines whether or not the printings are intermittent printing based on intermittent rotation time T in place of intermittent rotation distance Φ, which was described above, and further, sets second predetermined value $R_2$ and reference number of times $C_T$.

Control unit CU obtains intermittent rotation time T using a formula described below based on job information of the plurality of previous printing jobs OPJ which belong in an extent going back from just before current printing job CPJ by prescribed distance $L_b$ of rotation distance L of the above intermediate transfer body.

$$T=T_1+T_2 \quad \text{Formula (5):}$$

$$T_1=\Sigma TL_j \quad \text{Formula (6):}$$

$$T_2=\Sigma TR_j \quad \text{Formula (7):}$$

(j=1, 2, 3, . . . )

where, $TL_j$ is a time in which intermediate transfer body 6 rotated at each previous printing job OPJ; $TR_j$ is a time in which developing roller 40 rotated at each previous printing job OPJ, that is, developing section 4 operated; $T_1$ is a total time in which intermediate transfer body 6 rotated at the plurality of previous printing jobs OPJ; and $T_2$ is a total time in which developing section 4 operated at the plurality of previous printing jobs OPJ.

Embodiment (3) of Decision Control of Intermittent Printing

In embodiment (3) relating to a decision control of intermittent printing, control unit CU changes intermittent coefficient $D_j$, a decision criterion whether or not the printing was intermittent printing, based on average coverage rate GD (%) of images formed on photoreceptor 1, and further calculates total intermittent coefficients D based on intermittent coefficient $D_j$, which was obtained using Formula (1), in the similar way to above embodiment (1).

Table 4 is an example of a reference table which relates the number of sheets P "n" which were passed through at previous printing job OPJ to intermittent coefficient $D_j$, which is changed as shown described below based on average coverage rate GD (%) of an image.

TABLE 4

| The number | Intermittent coefficient $D_j$ | | |
|---|---|---|---|
| of sheets n | GD < 10 | 10 ≤ GD < 50 | 50 ≤ GD |
| 1 | 5.0 | 2.5 | 1.3 |
| 2 | 2.5 | 1.3 | 0.6 |
| 3 | 1.7 | 0.9 | 0.4 |
| 4 | 1.3 | 0.8 | 0.3 |
| 5 | 1.0 | 0.5 | 0.2 |
| 6 or more | 0 | 0 | 0 |

Control unit CU determines whether or not the printings are intermittent printing, based on total intermittent coefficients D which was obtained using Table 4, in the similar way to above embodiment (1). Further, control unit CU sets second predetermined value $R_2$ and reference number of times $C_T$.

Control unit CU also takes average coverage rate GD into consideration, and is capable of calculating more sensitively total intermittent coefficients D compared to embodiment (1) relating to the decision control of intermittent printing, and controls more finely the execution of the additional return action of blade configuration to more surely prevent cleaning failure caused by transfer of lubricant K, and to also make it possible to further improve the productivity of a printing job.

According to the above embodiment of the present invention, even in the case where continuous printing job was carried out after intermittent printing was repeated, cleaning failure can be prevented, and thereby a highly reliable image forming apparatus having no printing failure can be obtained.

In the above embodiments, control unit CU sets a timing to operate the additional return action of cleaning blade configuration (in the rotation amount of intermediate transfer body 6) using second predetermined value $R_2$ and reference number of times $C_T$, but may set at least two different second predetermined values $R_2$.

Control unit CU of the above embodiments attains the additional return action of cleaning blade configuration by stopping the rotation of intermediate transfer body 6, but structures are also in the scope of the present invention, in which the additional return action of cleaning blade configuration is attained by rotating intermediate transfer body 6 in the opposite direction to the rotating direction after the stop of intermediate transfer body 6, or by releasing the pressure contact of cleaning blade 802 after the stop.

What is claimed is:

1. An image forming apparatus comprising:

an image forming section including a photoreceptor, a charging section for charging the photoreceptor, an exposing section for exposing the photoreceptor charge by the charging section to form an electrostatic latent image, a developing section for developing the electrostatic latent image to form a toner image, an intermediate transfer body, a primary transfer section for transferring the toner image onto the intermediate transfer body, a secondary transfer section for transferring the toner image on the intermediate transfer body onto a sheet of paper, and a photoreceptor cleaning section having a lubricant applying section for applying a lubricant onto the photoreceptor;

a cleaning section for removing residual toner remaining on the intermediate transfer body by bringing a cleaning blade into close contact with the intermediate transfer body, and a control section for controlling a rotation of the intermediate transfer body so as to carry out a return action of a blade configuration which stops or reverses the rotation of the intermediate transfer body when a rotation amount of the intermediate transfer body, which continuously rotates, reaches a first predetermined value, wherein the control section carries out the return action of the blade configuration when the rotation amount of the intermediate transfer body in a current printing job reaches a second predetermined value which is smaller than the first predetermined value, in a case where a plurality of previous printing jobs, which were carried out prior to the current printing job at work, is determined to be intermittent printing in which the developing section has a high stop rate during rotation of the intermediate transfer body;

wherein the previous printing job is determined to be the intermittent printing or not, or the second predetermined value is set, based on a first rotated distance which is a total amount of distance in which the intermediate transfer body rotated in a plurality of previous printing jobs which fall under a range in which the rotation amount of the intermediate transfer body goes back by a predetermined amount from a job just before the current printing job, and a second rotated distance which is a total amount of distance in which the intermediate transfer body rotated during rotation of the developing section in the plurality of previous printing jobs which fall under a range in which the rotation amount of the intermediate transfer body goes back by a predetermined amount from a job just before the current printing job.

2. The image forming apparatus described in claim 1, wherein a criterion whether the previous printing job is the intermittent printing or not is changed, or the second predetermined value is set, based on an average coverage rate of an image formed by the plurality of previous printing jobs which fall under a range in which the rotation amount of the intermediate transfer body goes back by a predetermined amount from a job just before the current printing job.

3. An image forming apparatus comprising:

an image forming section including a photoreceptor, a charging section for charging the photoreceptor, an exposing section for exposing the photoreceptor charge by the charging section to form an electrostatic latent image, a developing section for developing the electrostatic latent image to form a toner image, an intermediate transfer body, a primary transfer section for transferring the toner image onto the intermediate transfer body, a secondary transfer section for transferring the toner image on the intermediate transfer body onto a sheet of paper, and a photoreceptor cleaning section having a lubricant applying section for applying a lubricant onto the photoreceptor;

a cleaning section for removing residual toner remaining on the intermediate transfer body by bringing cleaning blade into close contact with the intermediate transfer body, and a control section for controlling a rotation of the intermediate transfer body so as to carry out a return action of a blade configuration which stops or reverses the rotation of the intermediate transfer body when a rotation amount of the intermediate transfer body, which continuously rotates, reaches a first predetermined value, wherein the control section carries out the return action of the blade configuration when the rotation amount of the intermediate transfer body in a current printing job reaches a second predetermined value which is smaller than the first predetermined value, in a case where a plurality of previous printing jobs, which were carried out prior to the current printing job at work, is determined to be intermittent printing in which the developing section has a high stop rate during rotation of the intermediate transfer body;

wherein the plurality of previous printing jobs is determined to be the intermittent printing or not, or the second predetermined value is set, based on a number of sheets of paper which passed through for each of a plurality of previous printing jobs which fall under a range in which the rotation amount of the intermediate transfer body goes back by a predetermined amount of rotation from a job just before the current printing job; and wherein a criterion whether the previous printing job is the intermittent printing or not is changed or the second predetermined value is set, based on an average coverage rate of an image formed by the plurality of previous printing jobs which fall under a range in which the rotation amount of the intermediate transfer body goes back by a predetermined amount from a job just before the current printing job.

4. An image forming apparatus comprising:

an image forming section including a photoreceptor, a charging section for charging the photoreceptor, an exposing section for exposing the photoreceptor charge by the charging section to form an electrostatic latent image, a developing section for developing the electrostatic latent image to form a toner image, an intermediate transfer body, a primary transfer section for transferring the toner image onto the intermediate transfer body, a secondary transfer section for transferring the toner image on the intermediate transfer body onto a sheet of paper, and a photoreceptor cleaning section a lubricant applying section for applying a lubricant onto the photoreceptor;

a cleaning section for removing residual toner remaining on the intermediate transfer body by bringing a cleaning blade into close contact with the intermediate transfer body, and a control section for controlling a rotation of the intermediate transfer body so as to carry out a return action of a blade configuration which stops or reverses the rotation of the intermediate transfer body when a rotation amount of the intermediate transfer body, which continuously rotates, reaches a first predetermined value, wherein the control section carries out the return action of the blade configuration when the rotation amount of intermediate transfer body in a current printing job reaches a second predetermined value which is smaller than the first predetermined value, in a case where a plurality of previous printing jobs, which were carried out prior to the current printing job at work, is determined to be intermittent printing in which the developing section has a high stop rate during rotation of the intermediate transfer body;

wherein the previous printing job is determined to be the intermittent printing or not, or the second predetermined value is set, based on a rotation time of the intermediate transfer body which is a total amount of time in which the intermediate transfer body rotated in a plurality of previous printing jobs which fall under a range in which the rotation amount of the intermediate transfer body goes back by a predetermined amount of rotation from a job just before the current printing job, and on a working time of the developing section which is a total amount of time in which the developing section worked in the plurality of previous printing jobs which fail under a range in which the rotation amount of the intermediate transfer body goes back by a predetermined amount of rotation from a job lust before the current printing job.

5. The image forming apparatus described in claim 4, wherein a criterion whether the previous printing job is the intermittent printing or not is changed, or the second predetermined value is set, based on an average coverage rate of an image formed by the plurality of previous printing jobs which fall under a range in which the rotation amount of the intermediate transfer body goes back by a predetermined amount of rotation from a job just before the current printing job.

* * * * *